US007036300B2

(12) United States Patent
Brandl et al.

(10) Patent No.: US 7,036,300 B2
(45) Date of Patent: May 2, 2006

(54) PROCEDURE AND AN APPARATUS FOR START-UP SPINNING OF THE THREAD IN AN OPEN-END SPINNING APPARATUS

(75) Inventors: Sebastian Brandl, Böhmfeld (DE); Frank Baier, Geisenfeld (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 124 days.

(21) Appl. No.: 10/742,624

(22) Filed: Dec. 19, 2003

(65) Prior Publication Data

US 2005/0016156 A1 Jan. 27, 2005

(51) Int. Cl.
*D01H 4/48* (2006.01)

(52) U.S. Cl. ..... 57/263; 57/22

(58) Field of Classification Search ..... 57/22, 57/261, 263, 279, 404–417
See application file for complete search history.

(56) References Cited

U.S. PATENT DOCUMENTS 4,276,742 A 7/1981 Raasch et al.
4,644,742 A 2/1987 Lovas et al.
4,757,678 A * 7/1988 Stahlecker ..... 57/263
5,682,718 A * 11/1997 Bennewitz et al. ..... 57/263
6,339,921 B1 * 1/2002 Lassmann et al. ..... 57/264

FOREIGN PATENT DOCUMENTS

DE 10217243 10/2003
WO 0073548 A1 12/2000

OTHER PUBLICATIONS

European Patent Office Search Report, Feb. 15, 2005.

* cited by examiner

*Primary Examiner*—John J. Calvert
*Assistant Examiner*—Shaun R Hurley
(74) *Attorney, Agent, or Firm*—Dority & Manning, P.A.

(57) ABSTRACT

A procedure and apparatus for start-up spinning of a thread in an open-end spinning apparatus is provided. A first and second auxiliary roll-pair are presentable within a thread course during start up spinning. A source of a suction air stream within the spinning apparatus is positioned below the first and second roll-pairs. The source of suction air stream creates a suction flow of air to induce the thread end into the spinning apparatus for start up spinning. A control center is in communication with the first and second roll-pairs, so that the control center controls them. A thread storage unit is positioned between the first and second roll-pairs proximal to the course of the thread. The thread storage unit is in communication with the control center so that the thread storage unit is activated to store and release the thread during start up spinning.

19 Claims, 1 Drawing Sheet

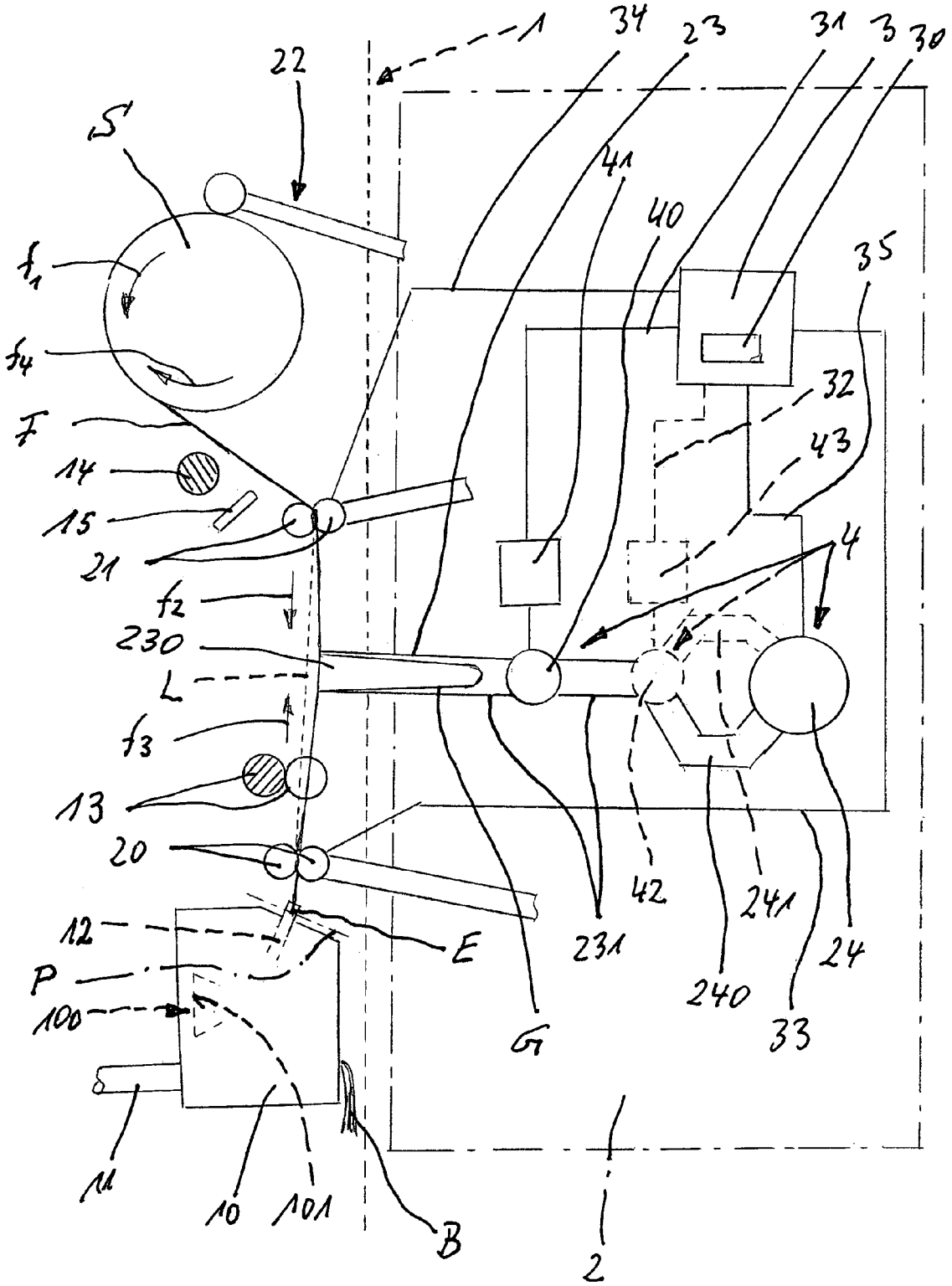
1
34
23
31
3
30
22
S
41
40
35
f1
f4
32
F
43
14
15
4
21
f2
230
L
f3
13
20
42
241
12
E
231
24
P
240
100
G
33
11
10
101
B
2

PROCEDURE AND AN APPARATUS FOR START-UP SPINNING OF THE THREAD IN AN OPEN-END SPINNING APPARATUS

BACKGROUND OF THE INVENTION

The present invention concerns both a procedure for start-up spinning of a thread in a open-end spinning apparatus and an apparatus for the execution of this procedure.

In accord with a known method, the end of a thread extending from a preparatory position in a thread withdrawal tube of a open-end spinning apparatus is conducted back to a fiber collection surface of an open-end spinning apparatus (DE 27 554 A1) by a sudden reversal of auxiliary rolls. By another reversal of rotation of the auxiliary rolls, the thread, now in its starting spinning operation, is once again withdrawn form the open-end spinning apparatus. The return delivery speed and the lost time up to the initiation of thread withdrawal depend upon the inertia of the auxiliary rolls. Especially, in view of today's customary high speed of rotation of the spin elements, which are designed as spin rotors with small rotor diameters, the dwell time, during which the returned thread end can remain on the fiber collection surface (that is, in the rotor grooving) until the start of the spinning withdrawal, can be measured in very short increments. This time period cannot be controlled by the known apparatus or it can only be maintained by the exercise of considerable effort.

SUMMARY OF THE INVENTION

A principal purpose of the present invention, on this account, is to create a procedure and an apparatus, with the help of which, in a very simple manner, it becomes possible to keep the dwell time of the thread end on the fiber collection surface optionally brief, and thereby achieve a thread-spinning start of higher quality. Various features and advantages of the invention will be set forth in part in the following description, or may be obvious from the description, or may be learned through practice of the invention.

This purpose is accomplished with a procedure for start-up spinning of a thread in a open-end spinning apparatus. During the procedure, two auxiliary roll pairs are stilled in their rotary revolutions to effect a continued clamping of a thread to conduct the thread end to a fiber collection surface after the introduction of the thread end into an active zone of a suction induced air flow. Subsequently, by means of a renewed drive of the second auxiliary roll-pair in a reverse direction, a thread surplus is created between the two auxiliary roll-pairs which surplus is intermediately stored. The second auxiliary roll-pair is then stopped, whereupon the intermediately stored thread is released and conducted to the fiber collection surface by the suction induced air flow. Thus, the return delivery of the thread end into the open-end spinning apparatus, on the one hand, and the withdrawal after start of spinning are executed by different means. During the advantageous, pneumatically activated back-delivery of the thread to the open-end spinning apparatus, the thread end is enabled to reach the fiber collection surface in the shortest possible time. Beyond this, the auxiliary roll-pairs which carry out this spin-start withdrawal, with this arrangement, can control the point in time of the start of the spinning withdrawal because of their speed of rotation and independent of the spin-start delivery of the thread end. This enables achieving the high value attachment procedure.

Advantageously, the amount of the intermediately stored thread length per the size of a fiber collection surface, the latter being a function of the diameter of a spinning rotor, can be of different settings. Accordingly, for a spinning start, an optimal ratio can always be chosen.

The thread end, during its reverse transport toward the active zone of the suction air stream, can be brought into a preparatory positioning stance opposite to the open-end spinning apparatus. Under this circumstance, the situation is such that, independent of the changeable geometric relationships, especially of dimensions, a conformance is required to accommodate the open-end spinning apparatus. This accommodation is arrived at by a changing of a single dimension, namely the length of the start-up thread, which is retained in the intervening thread storage unit. The thread, upon its release from the intervening storage, is entrained practically without inertia into the suction air stream entering the open-end spinning apparatus. Accordingly, at start-up, a variant measurement of the intervening thread length lead to no disadvantages during the reverse delivery of the thread end onto the fiber collection surface of the open-end spinning apparatus.

If, up to the moment of release of the advantageously pneumatically intervening storage of the thread, the air stream which contributed to the storage is stopped, or reverses itself in its direction, then an extremely rapid release of the thread for its start-up return delivery has been achieved.

For the execution of the procedure in accord with the invention, a special pneumatic thread storage is provided between the two auxiliary roll-pairs, which come into action for the reverse direction delivery of the thread to the open-end spinning apparatus. The special pneumatic thread storage, in like manner to the two roll-pairs, is governed by a common control system. This control system regulates, during the spinning start-up operation, the elements in such a manner, that the desired thread dwell time on the fiber collection surface is assured. Instead of the pneumatic thread storage unit, the thread can also be held back by mechanical means, for instance, by a reciprocating yoke or with a hold-back device driven by an electric motor.

In an advantageous development of the invention, provisions can be made, so that the control system possesses an adjustment apparatus, with the aid of which, the size of the desired thread length for the start-up spin return can be intermediately stored. Such a novel adjustment is especially advantageous, when the spin elements of different sizes of the fiber collection surface are optionally selected for use.

In order to bring about a rapid return delivery of the thread end to the fiber collection surface, advantageously the thread storage unit is provided with a positioning device.

The present invention enables an extremely fast return delivery of the thread to the fiber collection surface of an open-end spinning apparatus and permits, independent of this thread return, an initial withdrawal of the start-up spinning of the thread away from the fiber collection surface. In this way, provisions can be made in relation to an acceleration of the auxiliary roll-pairs, which enables a start-up spin withdrawal, so that this withdrawal starts its action before the thread end, fed back to the open-end spinning apparatus, finds itself on the fiber collection surface. In this manner, the necessary, invented equipment for the carrying out of the procedure in accord with the invention is simple and space saving in its construction. The equipment is also economical in cost.

One embodiment of the invention is explained in the following, with the aid of one drawing.

BRIEF DESCRIPTION OF THE DRAWING

FIG. 1 shows a schematic view of the elements necessary for back delivery in start-up thread spinning according to the invention.

DETAILED DESCRIPTION

Reference will now be made in detail to the presently claimed embodiments of the invention, one or more examples of which are shown in the FIGURE. Each example is provided to explain, and not is a limitation of the invention. In fact, features illustrated or described as part of one embodiment can be used with another embodiment to yield still a further embodiment. It is intended that the present invention cover such modifications and variations.

An open-end spinning machine (1) is depicted by a dotted line, shown at the left in FIG. 1. This machine possesses, as a rule, a multiplicity of similarly designed open-end spinning apparatuses 10, which are in communication with a suction line 11 and have a spinning element 100. The said spinning element 100, throughout this discussed embodiment, is designed as a spin rotor.

Other designs of the spinning element, such as, for example:

an electrostatically operated spinning element;

an air spinning element;

a friction spinning element; or a friction spinning element pair;

can possibly be given consideration in connection with the invention.

The open-end spinning apparatus 10 possesses further, among other elements, a fiber band feed opening (not shown), through which a fiber band B is conducted toward the open-end spinning apparatus 10, wherein the band is disintegrated into single fibers. The individual fibers are then conducted to the fiber collection surface 101 and over laid thereon. This construction, in accord with the design of the spinning element 100, may be constructed correspondingly in various manners. The fibers are continually bound into a thread end E of an unbroken thread F being withdrawn from the open-end spinning apparatus, which then exits the open-end spinning apparatus through a thread withdrawal tube 12.

The spun thread F, during the normal, undisturbed spinning process, with the aid of a main extraction roll-pair 13, is withdrawn form the open-end spinning apparatus 10 and wound on a spool S. the spool S is mounted on a driven spool axle 14. As this is done, the thread F passes a compensating thread tensioning yoke 15.

In the single FIGURE, to the right, presented with a dotted/dashed line is a multi-use service cart 2, with the help of which, following an interruption of the spinning procedure, a start-up action is initiated. The service cart 2 has the ability to run along the work stations of the open-end spinning apparatus 1, in order to carry out maintenance operations on the machine as required. In this way, the replacement of a full spool S by an empty spool can be carried out. The service cart 2 is also available for the cleaning of the spinning element 100 and, if necessary, other elements of the open-end spinning apparatus 10. It also has the capabilities of starting up the spinning after an interruption thereof.

For the execution of a start-up operation, the maintenance cart 2 possesses two auxiliary roll-pairs 20 and 21 of which the first auxiliary roll-pair 20 is brought into proximity with the opne-end spinning apparatus 10, in order that the thread end E can be brought into a preparatory position P in the active zone of the suction air stream. As soon as this occurs, the thread is entrained in the suction of the open-end spinning apparatus 10 and enters the thread withdrawal tube 12. The second auxiliary roll-pair 21, on the other hand, is placed at a greater distance from the open end spinning machine 10.

The first auxiliary roll-pair 20 is supported on bearing either in a pivotal manner or so that it can be slidingly moved. This placement has the advantage that the first roll-pair 20 can be brought out of an idling position (not shown) into an operational position. This movement can be stopped at a location for the pickup of the thread F and for the preparation of the thread end E, in order to bring these into a serviceable position for the spinning start.

The second auxiliary roll-pair 21 is so situated, that it can, at the latest, be brought into its shown operational position after the pickup of the thread F, which has been reversed by the spool S, where it will fulfill the purpose of carrying out a reverse delivery of the thread F in the direction of the open-end spinning apparatus. This action will be explained in more detail in the following. For this drive of the spool S in the reverse delivery of the thread F (see arrow $f_1$), a spool lifting device (not shown) as well as an auxiliary drive device 22 are made available. The auxiliary drive device 22 is to be found on the maintenance cart 2 and is presented to the spool S in accordance with the spinning start-up procedure and also provides the drive thereof.

A pneumatic thread storage unit 23 can be provided for the run of the thread between the two auxiliary roll pairs 20, 21. The thread storage unit 23 is connected by an air line 231 with a source of air 24. In this air line 231, a positioning device 4 is to be found that, in the shown embodiment, possesses a shut-off valve 40. The drive apparatus 41, for the shutoff valve is connected by a line 31 to control center 3. This control extends itself by another line 35 to regulate the source of air 24. Further, the first auxiliary roll-pair 20 is connected by means of a control line 33 to the control center 3, while the second auxiliary roll-pair 21 is connected to the control center 3 by control line 34. Obviously, the auxiliary drive device 22 for the spool S as well as the drive for the rods, or levers, which carry the auxiliary roll-pairs 20, 21, are likewise connected with the control center by additional lines not shown. In the interest of clarity in the drawing, these additional lines were omitted.

The control center 3 serves not only for the regulation of the previously mentioned elements, but also, during the spinning start procedure, provides control for other maintenance operations (for instance, a spool exchange). The control center 3 can control different elements not indicated on the drawing and for this additional control operation, makes use of control lines connection these elements and/or additional control units.

If, following an optional, or an involuntary interruption of the normal spinning operation, the normal spinning operation must be again started up, then, first, a so-called start-up procedure is to be carried out, which is controlled by the control center 3.

Initially, the maintenance cart 2 is conveyed to a particular open-end spinning apparatus 10 which is need of this service. This conveyance is effected by the regular patrolling along the open-end spinning apparatuses 10 with the aid of an emergency signal emitted by the out-of-service open-end spinning apparatus 10 at the occurrence of a disturbance of the spinning operation. As an alternative, the maintenance cart 2 can be so directed manually.

If the start-up spinning procedure is to serve for the correction of a thread break, the first action is, that the thread end is searched for on the spool S, and is then removed therefrom in a normal manner, so that the thread F, in a conventional way, can be picked up by the two auxiliary roll-pairs 20, 21.

After the described thread pickup, the auxiliary roll-pair 20 is caused to move to a thread end preparation unit (not shown), whereby the thread end E receives the necessary shape and length for a proper spinning start. Finally, the auxiliary roll-pair 20 reaches the area above the thread withdrawal tube 12. By means of corresponding driving of the two auxiliary roll-pairs 20, 21 during the return thread travel, (arrow $f_2$), care is taken, that the thread F is first conducted into the already mentioned preparatory position P in close proximity to the thread withdrawal tube 12 and thereby also into the active zone of the air stream. Further, because of the connection of the open-end spinning apparatus 10 to the suction line 11, the thread F is withdrawn from the open-end spinning apparatus 10 through the thread withdrawal tube 12. Second, between the two auxiliary roll-pairs 20, 21, a defined thread course L is created. When the thread F has attained this condition, then the rotation of the two auxiliary roll-pairs 20, 21 is stopped, but yet each pair holds the thread F by its own clamping line.

If the thread storage unit 23, because of its location in the maintenance cart 2, as the cart assumes its service position at a work station, does not find itself positioned, so that its opening 230 is in immediate proximity to the course L of the thread, then, at least, the pneumatic thread storage unit 23 is placed in the desired proximal position. Then, the second auxiliary roll-pair 21 starts a reverse thread delivery (arrow $f_2$). In this way, with the first auxiliary roll-pair 20 idling, a thread surplus is generated between the auxiliary roll-pairs 20, 21. This thread surplus, because of the suction existing in the pneumatic thread storage unit 23 is pulled therein, in the form of a thread loop G. The thread storage unit 23, due to its assigned shutoff valve 40 belonging to the positioning device 4, is in communication with the control center 3 by a control line. This connection brings about the suction in the thread storage unit 23, so that in the startup spinning procedure and responding to a timer, the blocking valve 40 is opened. When the thread loop G attains a specified size, then the second auxiliary roll-pair 21 is also shut down.

Coinciding with the fiber feed to the spinning element 100, which has begun again in a conventional manner, the clamping line of the first auxiliary roll-pair 20 is released, and the shutoff valve 40 of the positioning unit 4 is closed. By means of the thereby caused stoppage of the suction action in the thread storage unit 23, the length of the thread F which, up to that time, has been intermediately stored in the pneumatic thread storage 23, allows a sudden release of the end E, which is in the entrainment zone of the air stream flowing into the open-end spinning apparatus 10. The thread end E, which, up to this time, has assumed its preparatory position P, with the help of the suction induced air stream, is enabled to suddenly abut the fiber collection surface 101. Here, the thread end E quickly interbinds with fibers which are being fed into the collection surface 101. At the same time, the auxiliary roll-pair 21 is put into rotary motion, but this time in a withdrawal direction (arrow $f_3$). The thread F, now newly created by its binding with the continual feed of fibers to the fiber collection surface 101, is now immediately withdrawn, assisted by the second auxiliary roll-pair 21. When the thread withdrawal, activated by this second roll-pair 21, reaches its specified speed, then the thread F, in conventional manner, is laid into the clamping line of the main withdrawal roll pair 13, which is proximal to the machine side, and the thread is freed from the auxiliary roll pair 21. The thread withdrawal is forthwith carried on by the main withdrawal roll-pair 13.

It is obvious, that in accord with the spinning start-up, the spool S is once again dropped on the spool axle and driven by this axle in the windup direction (arrow $f_4$). Also, the elements, which were previously in contact with the thread F or the spool S, are once again retracted into their idle position within the maintenance cart 2. At this time, the maintenance cart 2 can leave the already served work station 10, in order to move to another work station and at that new place, undertake whatever service work may be necessary.

In the case of one embodiment, a specially designed start-up spool (not shown) in the maintenance cart 2 can be provided for a start-up procedure after the ejection of a full spool S and its replacement by an empty spool. This special spool would permit a start-thread to be withdrawn therefrom and inserted into the two auxiliary roll-pairs 20, 21. The start-up spinning would be carried out, in this case, in the method already described, with the difference from the above described procedure being in that the spinning-start procedure of the newly formed thread F is separate from the thread section, which originates with the start-up spool and must be transferred to the empty spool.

The invented procedure, as well as the apparatus in accord with the invention, can each be altered in a multiplicity of ways, especially by means of the substitution of individual features by equivalents or by other combinations of features, or again, by their equivalents. As an example, previously an embodiment has been described, wherein, on the maintenance cart 2, an integral source 24 of air in the form of a blower is installed. Instead of such a blower, provisions can also be made, so that the maintenance cart 2 can be connected by means of a (not shown) line with a machine-side suction air line.

In an alternate embodiment of the invented procedure, provisions can be made for the release of the thread, wherein the suction need not necessarily be shut off, as this has been described in relation to the shutoff valve. In this alternate, the thread storage unit 23 is subjected to a positive pressure for the release of the thread, so that the freeing of the thread necessary for the return delivery of the spinning start-up is activated by the application of a positive pressure air stream. To this end, the positioning device 4 possesses a reverse-flow valve 42 between the shutoff valve 40 and the source of air 24 (shown in the drawing with dotted lines). With help of this reverse flow valve 42, the air line 231 can be connected optionally with a suction line 240, which is connected with the suction side of the air source, or with a positive pressure line 241, which is accordingly connected with the positive pressure side of the air source. Openings (not shown) which are free to the atmosphere are employed for the exhaust of the air brought in by the suction action, when the thread storage unit 23 is connected with the suction line 240. Correspondingly, these openings are used for the intake of air when the thread storage unit 23 is connected with the positive pressure line 241. For the purpose of general clarity, this alternate piping is not shown on the drawing. The reverse flow valve 42 is likewise dedicated to a drive apparatus 43, which is connected by control line 32 with the control center 3.

If, in a case of a still standing first auxiliary roll-pair 20, the second auxiliary roll-pair 21 returns the thread F so that a thread surplus is created, which is accordingly stored in the pneumatic thread storage unit 23, then the backflow valve 42, assisted by its drive operator, is controlled so that the air line 231 becomes connected with the suction line 240. This interconnection is maintained for such a period, until a sufficiently large loop G is built up in the thread storage unit 23 to enable a return delivery for the spinning start. At this point, the second auxiliary roll-pair 21 is stopped from rotation. In order to free the thread F to allow a rapid entrainment in the suction air flow by means of the suction available in the open-end spinning apparatus, the corresponding control by the control center 3 brings the reverse flow valve 42 back into its other operational position, in which it connects the air line 231 with the pressure line 241. In this way, the direction of flow of the air stream which is present in the thread storing unit 23 is reversed. The thread loop G is thus expelled from the thread storage unit 23 and picked up by suction to move into the thread withdrawal tube 12 of the open-end spinning apparatus 10. The thread F then contacts the fiber collection surface 101 and there intertwines with the collecting fibers. By means of a corresponding, preselected time of beginning of the thread withdrawal, with the aid of the auxiliary roll-pair 21, which is driven in the direction of the arrow $f_3$, the takeover of the thread withdrawal by the main withdrawal roll-pair 13 is effected and the start-up procedure is concluded.

Since the flow of air, which is active immediately in front of the opening of the thread storage unit 23, presents no damaging effects, it is possible that the shutoff valve 40 can be eliminated and the positioning apparatus 4 substituted by the air source 24 in connection with the control center 3. In this manner, by means of the control center 3, the air source 24 can be correspondingly switched ON and OFF. However, as a rule, the shutoff valve 40 is installed for economic reasons and to achieve a desired high equipment response speed.

As has been previously provided, a thread loop G is formed to a specified size in the thread storage unit 23. The thread loop G can principally always show the same size, so that the second auxiliary roll-pair 21 must always perform the same number of rotations in order to create a loop G of such a size.

Frequently, however, the provisions are made so that a spinning element 100 can be exchanged to suit the fiber material to be spun or to achieve a defined thread character in contrast to another. In a corresponding manner, when this is done, it is often a requirement to simultaneously exchange a spinning element top. The spinning element top directly covers the housing which encloses the spinning element 100 or covers the spinning element itself or a spinning element pair. This replacement is associated with changed geometric relationships. In the most simple case, the size of the thread loop G is determined at an average value. More to the point, however, the size of the thread loop G is originally adjusted in accord with the changed geometrical relationships of the open-end spinning apparatus, as this will be explained in the following.

For the achievement of optimal startup spinning relationships, even the thread loop G can be dimensioned in different sizes. If, for example, the spinning element 100 is designed as a spinning rotor, then the thread loop G is to accommodate in particular a size that is complementary to the newly installed spin rotor. That is to say, smaller spin rotors require a smaller thread loop G. Thereby, a lesser thread loop G would be employed than need be provided with larger spinning rotors and vice versa.

This fitting of the size of the thread loop G to the existing geometric relationships of the open end spinning apparatus 10 is done with the aid of the control center 3, which correspondingly controls the second auxiliary roll-pair 21.

To this end, the control center 3 possesses, in accord with the illustrated embodiment, an adjustment apparatus 30, allowing the required data to be input. The input can be carried out in various ways, whereby the adjustment apparatus 30 is designed in a correspondingly fit manner. In this way, corresponding keys (not shown) are provided so that the required inputs can be made in a direct or an indirect manner. The adjustment apparatus can, however, also possess a device for the reception and readout of data carriers, for instance, a CD-ROM, a data carrying band or chips or the like.

In order to achieve the most simple control of the thread return delivery, in accord with the foregoing description of the procedure, only a single value is a variable. It is then advantageous, if the return delivery of the thread end E into, for example, the thread withdrawal nozzle 12 is always chosen to be of the same magnitude. This would be independent as to which thread length should be reserved for the actual start-up spinning in the thread storage unit 23.

In a preferred embodiment of the invented procedure, the thread F is brought with its thread end E, prior to the formation of a thread surplus—for an intermediary stored start-up spinning reserve—into a preparatory position P in the immediate propinquity of the thread withdrawal nozzle 12. Further, this preparatory position P holds to an unchangeable location always exactly opposite to the open-end spinning apparatus 10, independent of any currently given geometric relationships.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A procedure for start-up spinning of a thread in an open-end spinning apparatus, the procedure comprising the steps of:

conducting a thread end of a thread to an active zone of a suction induced air stream entering an open-end spinning apparatus by a first roll-pair of two auxiliary roll-pairs;

creating a surplus of the thread by driving a second roll-pair of the two auxiliary roll-pairs in a reverse direction as compared to the normal direction travel for the thread when under normal production;

storing the surplus of the thread in a thread storage unit disposed between the first roll-pair and the second roll-pair of the two auxiliary roll-pairs;

stopping the driving of the second roll-pair of the two auxiliary roll-pairs in the reverse direction;

releasing the thread from the thread storage unit; and conducting the thread end into the open-end spinning apparatus to a fiber collection surface.

2. A procedure as in claim 1, wherein the thread is positioned in the thread storage unit mechanically.

3. A procedure as in claim 2, wherein the thread is positioned in the thread storage unit electromechanically.

4. A procedure as in claim 2, wherein the thread is positioned in the thread storage unit pneumatically.

5. A procedure as in claim 4, wherein the thread storage unit creates a suction action to pull the thread into the thread storage unit.

6. A procedure as in claim 5, wherein the suction in the thread storage unit is reversed in direction to blow the thread out of the thread storage unit when the thread is released.

7. A procedure as in claim 1, wherein the amount of surplus thread is adaptable depending upon the geometric relationships within the open-end spinning apparatus that are changeable to attain preselected thread characteristics.

8. A procedure as in claim 7, wherein said open-end spinning apparatus employs a spin rotor, whereby the amount of surplus thread stored is dependent upon the diameter of the spin rotor.

9. A procedure as in claim 1, further comprising conducting the thread end of the thread into a preparatory position opposite the open-end spinning apparatus in the active zone of the suction induced air stream.

10. An apparatus for start-up spinning of a thread in an open-end spinning apparatus having a fiber collection surface, said apparatus comprising:

a first auxiliary roll-pair and a second auxiliary roll-pair presentable within a course of a thread during start up spinning;

a main withdrawal roll-pair proximal to said first and second auxiliary roll-pairs, said main withdrawal roll-pair actively engaging said thread after completion of said start up spinning;

a source of a suction air stream within said spinning apparatus positioned below said first and second roll-pairs, said source of suction air stream creating a suction flow of air to induce an end of said thread into said spinning apparatus for said start up spinning;

a control center in communication with said first and second roll-pairs, said control center controlling said first and second roll-pairs during said start up spinning; and a thread storage unit positioned between said first and second roll-pairs proximal to said course of said thread, said thread storage unit in communication with said control center so that said thread storage unit is activated to store and release said thread during said start up spinning.

11. An apparatus as in claim 10, wherein said thread storage unit is activated mechanically.

12. An apparatus as in claim 11, wherein said thread storage unit is activated electromechanically.

13. An apparatus as in claim 11, wherein said thread storage unit is activated pneumatically.

14. An apparatus as in claim 13, wherein said pneumatic thread storage unit is in communication with a positioning device for attaining and releasing said thread surplus.

15. An apparatus as in claim 14, wherein said positioning device includes at least one of a shutoff valve or a reversing valve.

16. An apparatus as in claim 10, wherein said control center includes an adjustable apparatus for controlling said second auxiliary roll-pair so that said second auxiliary roll-pair engages said thread to create a thread surplus for use during start up spinning.

17. An apparatus as in claim 16, wherein an amount of said thread surplus is regulatable by adjusting said adjustable apparatus for controlling said second auxiliary roll-pair.

18. An apparatus as in claim 17, wherein said adjustable apparatus controls the rotation of said second auxiliary roll-pair.

19. An apparatus as in claim 18, wherein said second auxiliary roll-pair are reversible in rotation so that said second auxiliary roll-pair are rotatable in a direction that is opposite to an operational direction of travel of said thread during normal spinning.

* * * * *